US011053713B2

(12) United States Patent
Parsons et al.

(10) Patent No.: US 11,053,713 B2
(45) Date of Patent: Jul. 6, 2021

(54) CARRYING CASE FOR RIGID HANDCUFFS

(71) Applicant: Armament Systems and Procedures, Inc., Appleton, WI (US)

(72) Inventors: Kevin Parsons, Appleton, WI (US); Siu Ngai Wang, Kowloon (HK)

(73) Assignee: ARMAMENT SYSTEMS AND PROCEDURES, INC, Appleton, WI (US)

( * ) Notice: Subject to any disclaimer, the term of this patent is extended or adjusted under 35 U.S.C. 154(b) by 342 days.

(21) Appl. No.: 16/235,929

(22) Filed: Dec. 28, 2018

(65) Prior Publication Data

US 2020/0208443 A1 Jul. 2, 2020

(51) Int. Cl.
*E05B 75/00* (2006.01)

(52) U.S. Cl.
CPC ..... *E05B 75/005* (2013.01)

(58) Field of Classification Search
CPC ..... E05B 75/00; E05B 75/005; A45F 5/02; A45F 5/021; A45F 2200/0566
USPC ..... 70/15–17; D3/215, 222; 24/3.1, 3.7, 3.9, 24/2.11, 3.12; 224/914, 197, 666, 669, 224/676, 678, 242
See application file for complete search history.

(56) References Cited

U.S. PATENT DOCUMENTS 1,517,588 A * 12/1924 Sasaki ..... E05B 75/00 224/242
1,894,540 A * 1/1933 Peirce ..... E05B 75/00 224/242
3,384,277 A * 5/1968 Hodelka ..... A45F 5/14 224/242
4,419,794 A * 12/1983 Horton, Jr. ..... A45F 5/02 224/197
4,852,784 A * 8/1989 Burton, Jr. ..... E05B 75/00 224/255
4,951,857 A * 8/1990 Carr ..... A45F 5/02 211/65
4,955,518 A * 9/1990 Parsons ..... A45F 5/02 224/247
5,711,468 A * 1/1998 Shoemaker ..... A45F 5/02 224/251
6,497,349 B1 * 12/2002 Ramirez ..... A45F 5/00 224/200
7,010,943 B1 * 3/2006 Earl ..... E05B 75/00 70/16
7,284,399 B1 * 10/2007 Sisco ..... E05B 75/00 119/816
8,522,581 B2 * 9/2013 Thompson ..... E05B 75/00 70/16
9,476,670 B2 * 10/2016 Parsons ..... F41C 33/041
10,362,856 B2 * 7/2019 Parsons ..... A45F 5/021
2003/0085244 A1 * 5/2003 Parsons ..... A45F 5/02 224/197
2005/0115997 A1 * 6/2005 Nouvel De La Fleche ..... E05B 75/00 224/162
2009/0277229 A1 * 11/2009 Smith ..... E05B 75/00 70/16

(Continued)

FOREIGN PATENT DOCUMENTS

FR 2865118 * 7/2005
GB 2284443 * 6/1995

*Primary Examiner* — Lloyd A Gall
(74) *Attorney, Agent, or Firm* — Hahn Loeser & Parks LLP

(57) ABSTRACT

A carrying case for a pair of rigid handcuffs is described.

21 Claims, 10 Drawing Sheets

(56) References Cited

U.S. PATENT DOCUMENTS

2015/0282598 A1* 10/2015 Loveday ..... A41D 1/089
224/148.6

* cited by examiner

CARRYING CASE FOR RIGID HANDCUFFS

FIELD OF THE INVENTION

The invention generally relates to a carrying case for a pair of rigid handcuffs.

BACKGROUND AND SUMMARY

In general, a pair of rigid handcuffs comprises two handcuffs and a middle section rigidly joining the two handcuffs so that the two handcuffs are not movable relative to each other. While a pair of rigid handcuffs has some security and ergonomic advantages relative to pairs of handcuffs that are not rigid, it cannot be carried by a security official in as small a container as a more traditional pair of handcuffs can be carried. The present disclosure describes and claims a carrying case in which a pair of rigid handcuffs may be carried conveniently.

BRIEF DESCRIPTION OF THE DRAWINGS

The following drawings illustrate the concepts of the present invention. Illustrations of an exemplary device are not necessarily drawn to scale.

DETAILED DESCRIPTION

Figure 1:
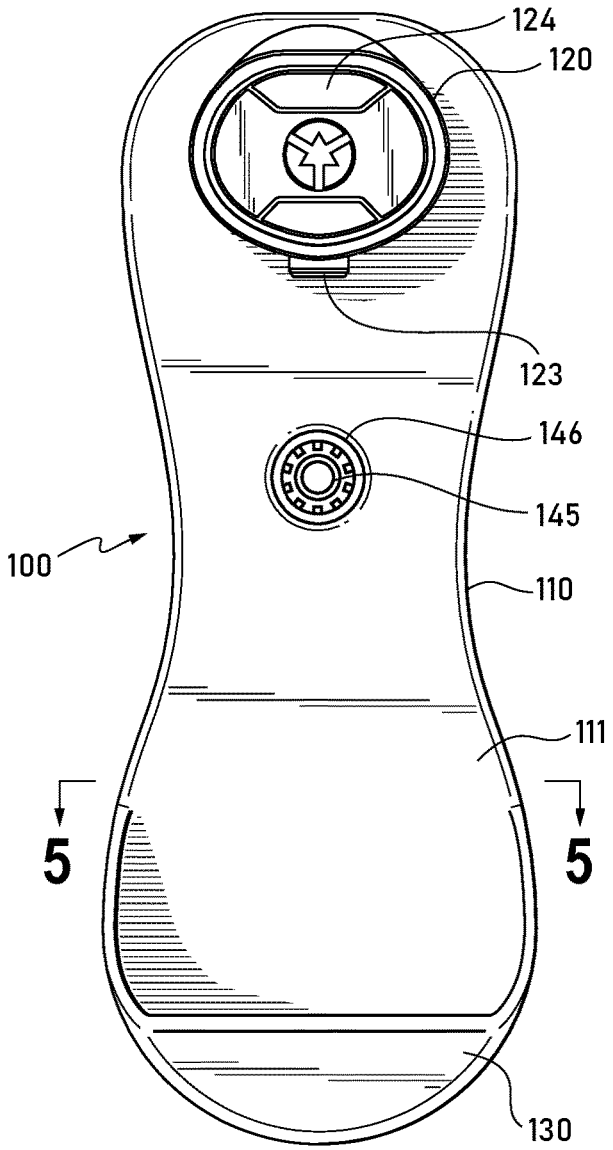
FIG. 1 is a front view of an embodiment of the disclosed carrying case.
Figure 2:
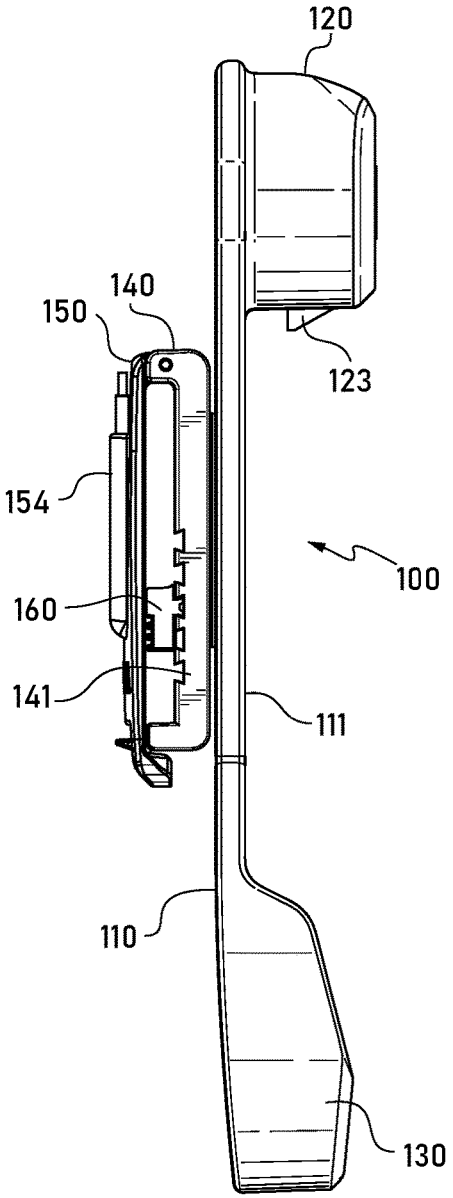
FIG. 2 is a side view of the embodiment of FIG. 1.
Figure 3:
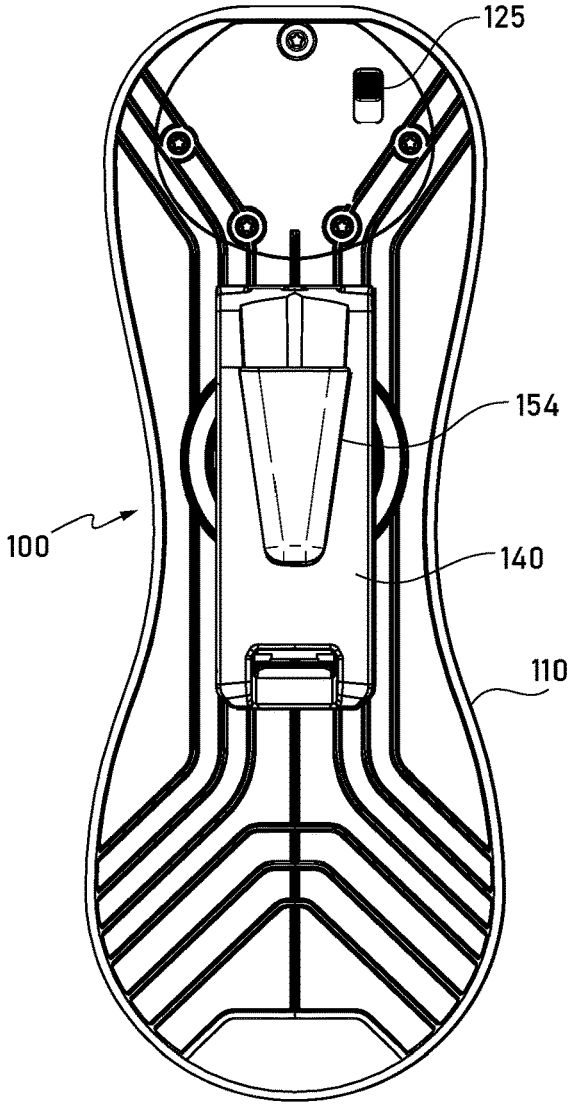
FIG. 3 is a rear view of the embodiment of FIG. 1.
Figure 4:
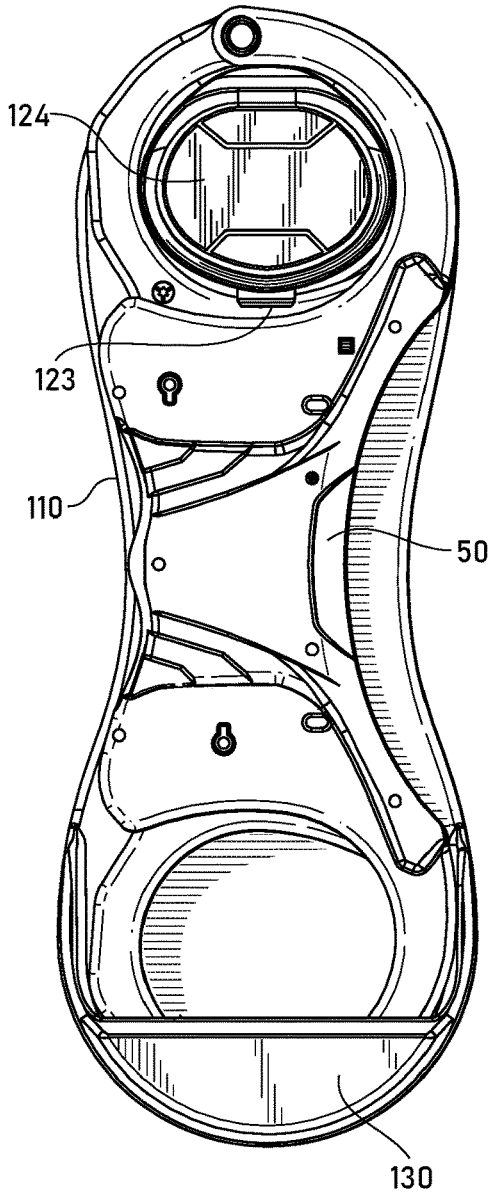
FIG. 4 is a front view of the embodiment of FIG. 1, with a pair of rigid handcuffs received in the case.

FIGS. 1-3 illustrate front, side and rear views, respectively, of one embodiment of a carrying case 100 for carrying a pair of rigid handcuffs 50. FIG. 4 illustrates the carrying case 100 of FIG. 1 with a pair of rigid handcuffs 50 received in the case 100. The case comprises a rigid frame 110. A front side of the frame 110 is structured and dimensioned to receive each one of the two handcuffs of the rigid pair of handcuffs 50 at respective ends of the case 100, and has a substantially planar surface 111 between the two ends. As best seen in FIG. 2, a clip 140 is joined to a rear side of the frame 110, such as for clipping the case 100 to one's clothing, for example.

In the embodiment illustrated in FIGS. 1-4, one end of the frame 110 comprises a protrusion 120 on the front side of the frame 110 for receiving one of the two handcuffs of the rigid pair of handcuffs 50. The protrusion 120 is structured and dimensioned to be surrounded by one of the two handcuffs. For example, the protrusion 120 can be substantially oval-shaped as best seen in FIG. 1.

Figure 5:
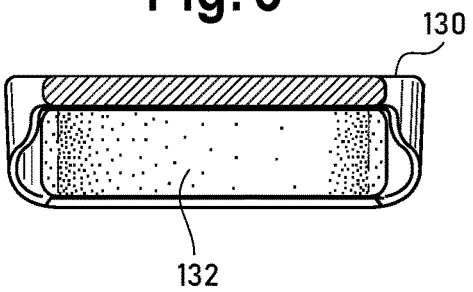
FIG. 5 is a sectional view taken along 5-5 of FIG. 1, showing the inside of a pocket at one end of the case.

In the embodiment illustrated in FIGS. 1-4, the other end of the frame 110 comprises a pocket 130 on the front side of the frame 110 for receiving the other one of the two handcuffs of the rigid pair of handcuffs 50. The pocket 130 is structured and dimensioned to block removal of the handcuff from the pocket 130 except in a direction substantially towards the other end of the frame 110. For example, the pocket 130 may be arc-shaped as best seen in FIGS. 1 and 4. In some examples, the inside of the pocket 130 comprises a cushion 132 as illustrated in FIG. 5. In some examples, the frame 110 is dimensioned so that the rigid pair of handcuffs 50 touches or is close to the cushion 132 when it is received in the case 100, and the cushion 132 diminishes any noise resulting from the pair of rigid handcuffs 50 being carried in the case 100.

The frame 110 also comprises a flexible retaining mechanism 122 that impedes removal of the pair of rigid handcuffs 50 from the case 100 unless the retaining mechanism 122 is released. In some examples, the retaining mechanism 122 is biased towards a retaining position in which the retaining mechanism 122 impedes the removal of the pair of rigid handcuffs 50 from the case 100, and is adapted to be flexed to a releasing position in which removal of the pair of rigid handcuffs 50 from the case 100 is not prevented by the retaining mechanism 122. In the embodiment illustrated in FIGS. 1 and 4, the retaining mechanism 122 is flexed to allow receipt of the rigid pair of handcuffs 50 as a handcuff is pushed over the protrusion 120, and is biased to flex back to a retaining position to impede removal of the cuff from around the protrusion 120.

Figure 10:
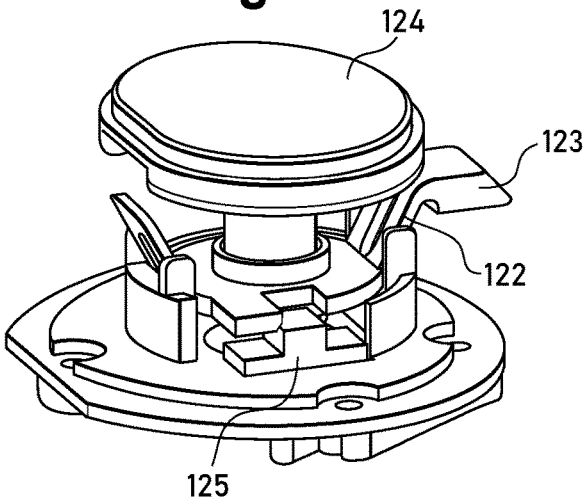
FIG. 10 depicts details showing operation of a retaining mechanism of the embodiment of FIG. 1, with a lock switch in the unlocked position.
Figure 11:
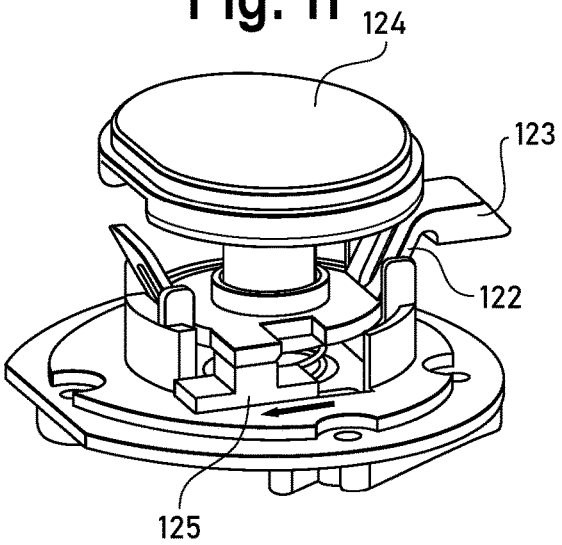
FIG. 11 depicts details showing operation of the retaining mechanism of the embodiment of FIG. 1, with the lock switch in the locked position.

FIGS. 10 and 11 depict details showing an example of operation of the retaining mechanism 122. In the embodiment of FIGS. 10 and 11, the retaining mechanism 122 has a wedge-shaped end 123 that is biased to protrude through a side of protrusion 120 (as seen in FIGS. 1, 2 and 4). When a handcuff is pushed over the protrusion 120, it is pushed against the wedge-shaped end 123 of the retaining mechanism 122 that protrudes through a side of the protrusion 120, flexing the retaining mechanism 122 so that wedge-shaped end 123 is withdrawn into the protrusion 120 allowing the handcuff to move down over and surrounding the protrusion 120. After the handcuff moves past the wedge-shaped end 123, the retaining mechanism 122 is biased to flex back to its retaining position, moving the wedge-shaped end 123 back through the side of the protrusion 120. A bottom horizontal side of the wedge-shaped end 123 then impedes removal of the handcuff from around the protrusion 120.

When a releasing mechanism 124 is activated, it moves the retaining mechanism 122 to a releasing position to allow removal of the pair of rigid handcuffs 50 from the case 100. For example, releasing mechanism 124 is illustrated as a button accessible at the top of the protrusion 120. If the releasing mechanism 124 is pushed, it pushes down the retaining mechanism 122 which is flexed so that the wedge-shaped end 123 is withdrawn into the protrusion 120, allowing the handcuff to be released from around the protrusion 120. A lock switch 125 is accessible on the rear side of the frame 110. In the example illustrated in FIGS. 10 and 11, the lock switch 125 prevents activation of the releasing mechanism 124 by blocking the retaining mechanism 122 from being pushed down when the lock switch 125 is in a locked position as seen in FIG. 11 (i.e., when the lock switch 125 is pushed in the direction of the arrow in FIG. 11). When the lock switch is in an unlocked position as seen in FIG. 10, it does not block the retaining mechanism 122 from being pushed down and does not prevent activation of the releasing mechanism 124. However, the retaining mechanism 122 still can be flexed by pushing in the wedge-shaped end 123, even if the retaining mechanism 122 cannot be pushed down. Consequently, the handcuff still can be pushed over the protrusion 120 and received in the case 100 when the lock switch 125 is in the locked position, but it cannot be released from the case 100 unless the lock switch 125 is in the unlocked position and the releasing mechanism 124 is activated.

Figure 6:
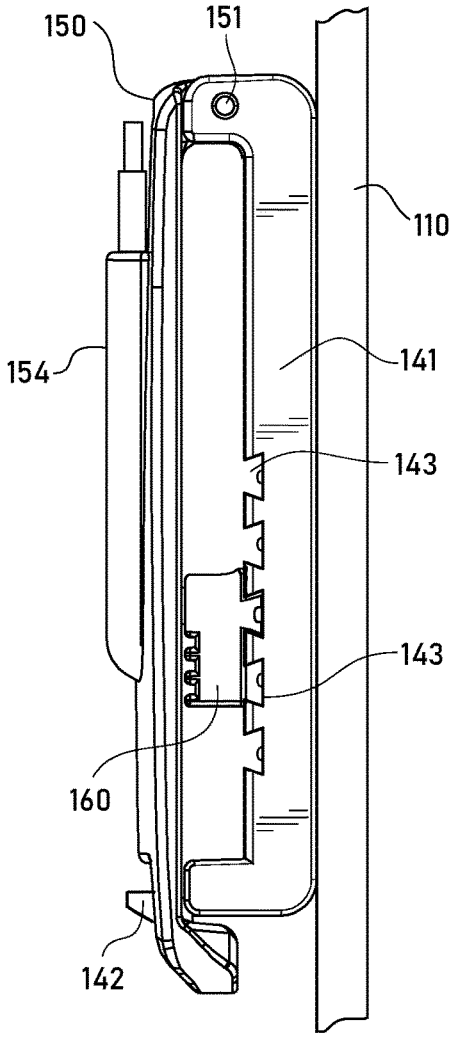
FIG. 6 is an enlarged side view of a clip on the rear side of the case of the embodiment of FIG. 1.
Figure 7:
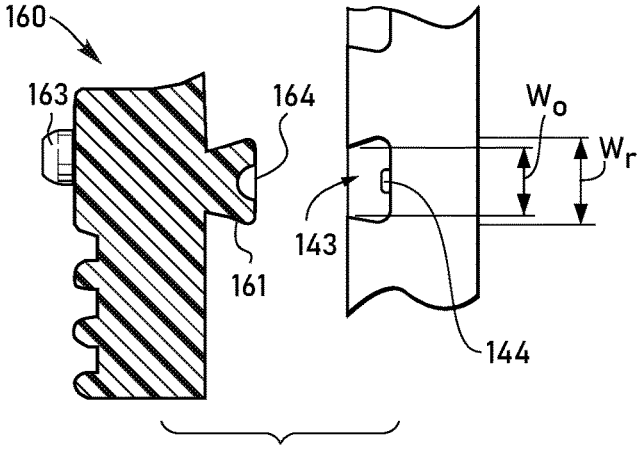
FIG. 7 is an enlarged view of an adjustable spacer shown in FIG. 6, and of a portion of a mounting plate into which the adjustable spacer is installed as shown in FIG. 6.
Figure 8:
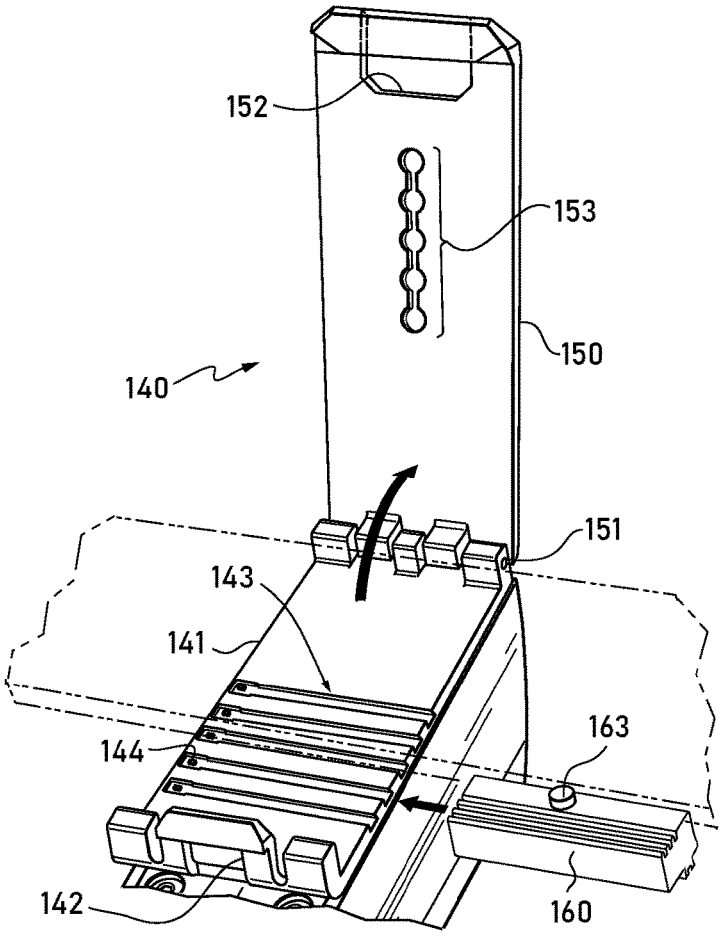
FIG. 8 is a perspective view of the clip of the embodiment of FIG. 1, with the clip open.

In the embodiment illustrated in FIGS. 2 and 3, there is a clip 140 joined to the rear side of the frame 110. The clip 140 can be used to attach the case 100 to a user's belt, for example. FIG. 6 is an enlarged side view of the clip 140, FIG. 7 is an enlarged view of an adjustable spacer 160 to accommodate attachment of the clip 140 to a plurality of different size items. FIG. 8 is a perspective view of the clip 140 in an open position. The clip 140 comprises a mounting plate 141 and a cover plate 150 that are joined at a first longitudinal end by a hinge 151. A resilient locking arm 142 that is located at an opposite second longitudinal end of the mounting plate 141 releasably engages with an aperture 152 at the second longitudinal end of the cover plate 150 to lock the clip 140 closed.

In the illustrated example, a number of slots 143 extend across the mounting plate 141, and the adjustable spacer 160 is releasably installed in one of the slots 143. The width $w_r$ at the root of each slot 143 is greater than the width $w_o$ at the opening of each slot 143, and width of an engaging portion 161 of the adjustable spacer 160 varies similarly and is sized to fit snugly into any of the slots 143. The adjustable spacer 160 also is held in place because a dimple 164 at the end of the engaging portion 161 engages with one of the bumps 144 that are located at the blind end of each slot 143, respectively, and because a peg 163 on the top of the adjustable spacer 160 engages with one of the apertures 153 in the cover plate 150.

Figure 9:
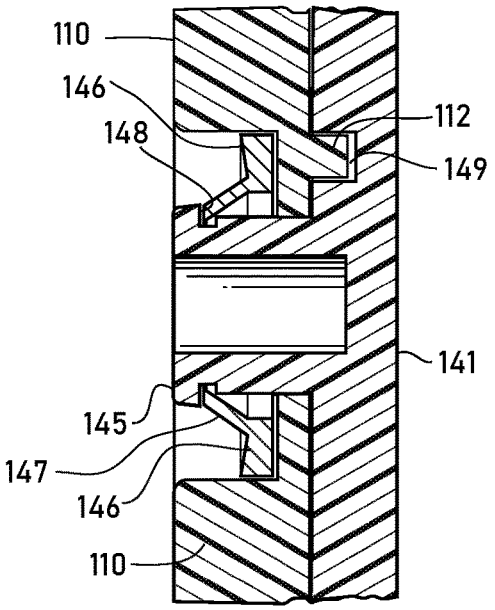
FIG. 9 is an enlarged sectional view of a pivotal joint rotatably joining the clip to the frame of the embodiment of FIG. 1.

FIG. 9 is an enlarged sectional view of an example of a pivotal joint rotatably joining the clip 140 to the frame 110. The mounting plate 141 includes a hub 145 that extends through an aperture in the frame 110. A retaining ring 146 is slid over the hub 145 and resilient projections 147 on an inner diameter of the retaining ring 146 engage one or more slots 148 on the hub 145 to secure the retaining ring 146 to the mounting plate 141. Various resilient projections and slots in the retaining ring 146 and the frame 110 facilitate retention of the case 100 at any one of a plurality of predetermined orientations with respect to the clip 140. In that way, the case 100 can be reoriented such as because a user is sitting rather than standing, and so forth. A post 112 in the frame 110 engages an arcuate slot 149 in the mounting plate 141 to allow rotation of the frame 110 relative to the clip 140 only through a predetermined arc.

In the embodiment illustrated in FIGS. 2, 3 and 6, the cover plate 150 includes a key pocket 154 that is structured and dimensioned to receive a key for the rigid pair of handcuffs 50. A top of a key is visible above key pocket 154 in FIGS. 2 and 6, and is omitted from FIG. 3. Similarly, in another embodiment discussed below, a top of a key is visible above key pocket 154 in FIGS. 16A and 16B, and is omitted from FIG. 17.

Figure 12:
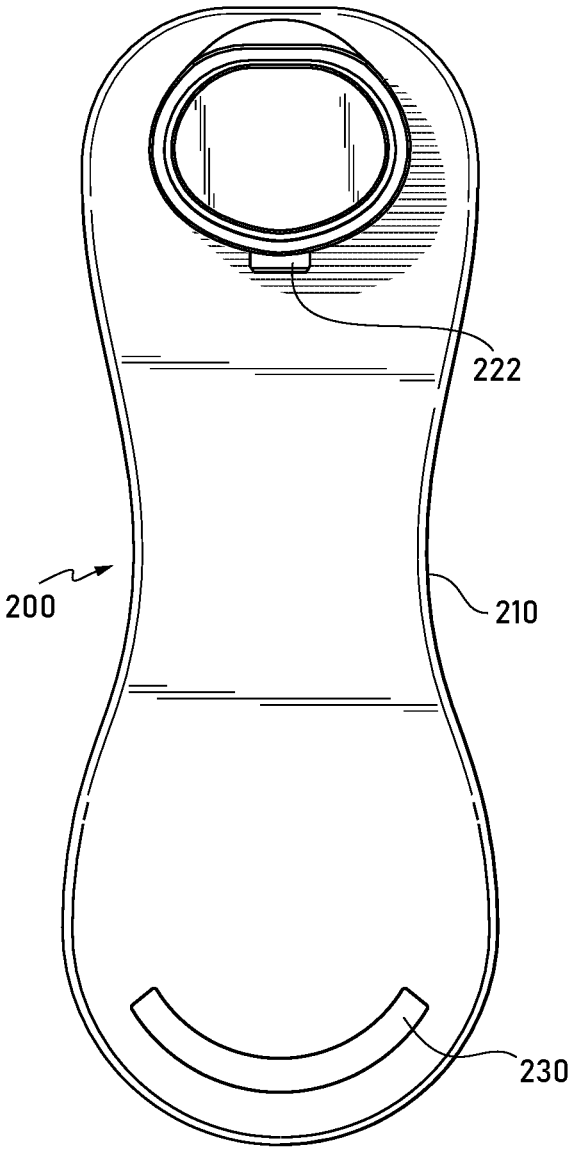
FIG. 12 is a front view of an embodiment with a different receptacle for receiving one of the handcuffs.
Figure 13:
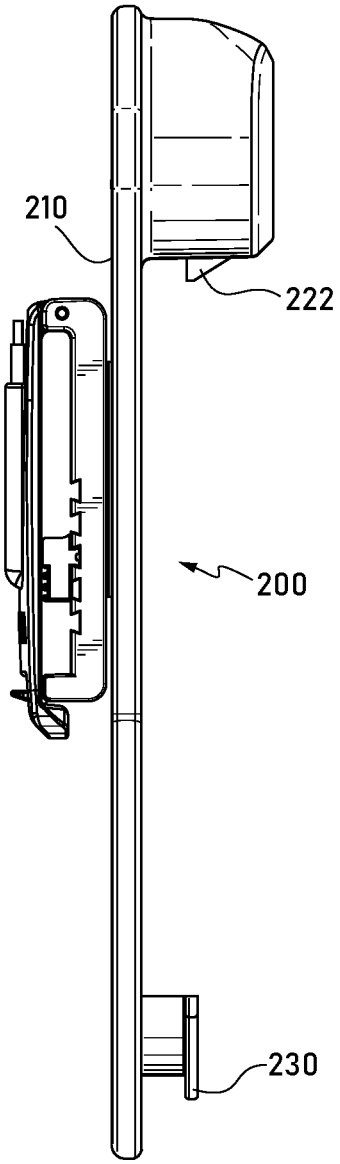
FIG. 13 is a side view of the embodiment of FIG. 12.
Figure 14:
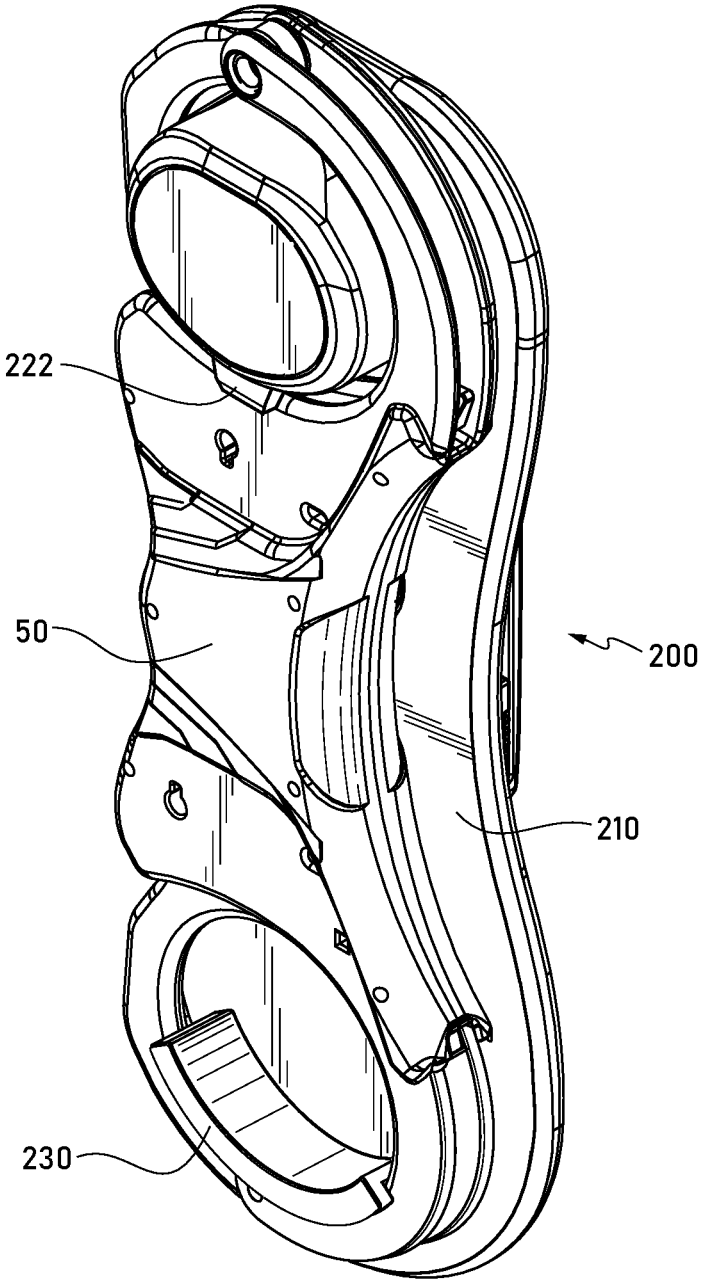
FIG. 14 is a perspective view of the embodiment of FIG. 12, with a pair of rigid handcuffs received in the case.

FIGS. 12 and 13 illustrate front and side views, respectively, of another embodiment of a carrying case 200 for carrying a pair of rigid handcuffs 50. FIG. 14 illustrates the carrying case 200 of FIG. 12 with a pair of rigid handcuffs 50 received in the case 200. A difference between carrying case 100 of FIG. 1 and carrying case 200 of FIG. 12 is that, instead of the pocket 130 seen in FIGS. 1, 2 and 4, an end of frame 210 of carrying case 200 comprises a protrusion 230 for receiving one of the two handcuffs of the rigid pair of handcuffs 50. The protrusion 230 is structured and dimensioned to be surrounded by that one of the two handcuffs, and to block removal of that one of the two handcuffs from around the protrusion 230 when the retaining mechanism 222 impedes removal of the other of the two handcuffs from the other end of the frame 210.

Figure 15A:
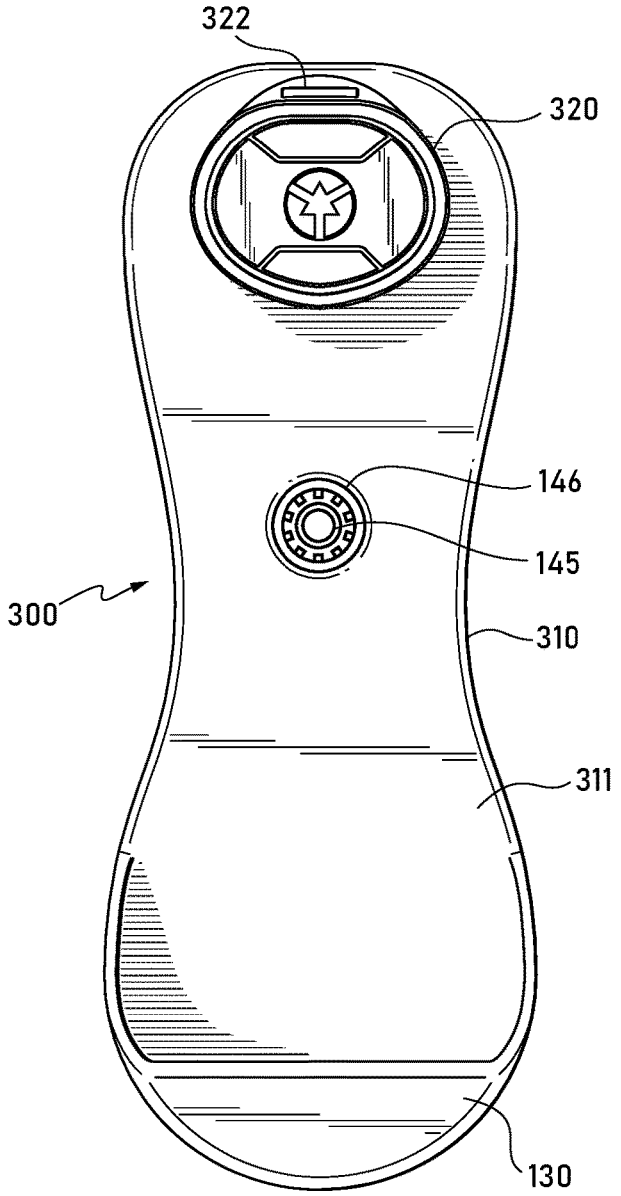
FIGS. 15A and 15B are front views of an embodiment with a different retaining mechanism and a different lock switch, with the retaining mechanism in retracted and extended positions, respectively.
Figure 16A:
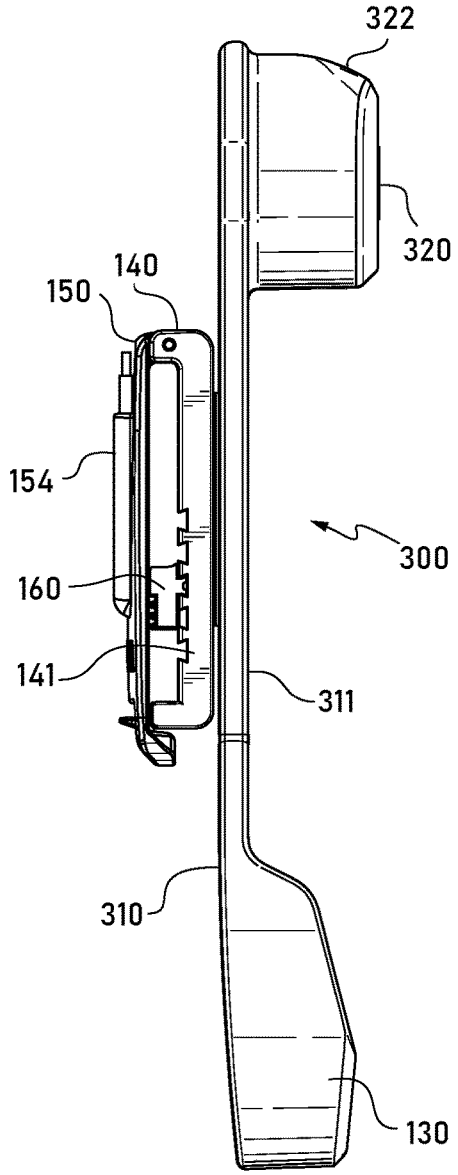
FIGS. 16A and 16B are side views of the embodiment of FIGS. 15A and 15B, with the retaining mechanism in retracted and extended positions, respectively.
Figure 15B:
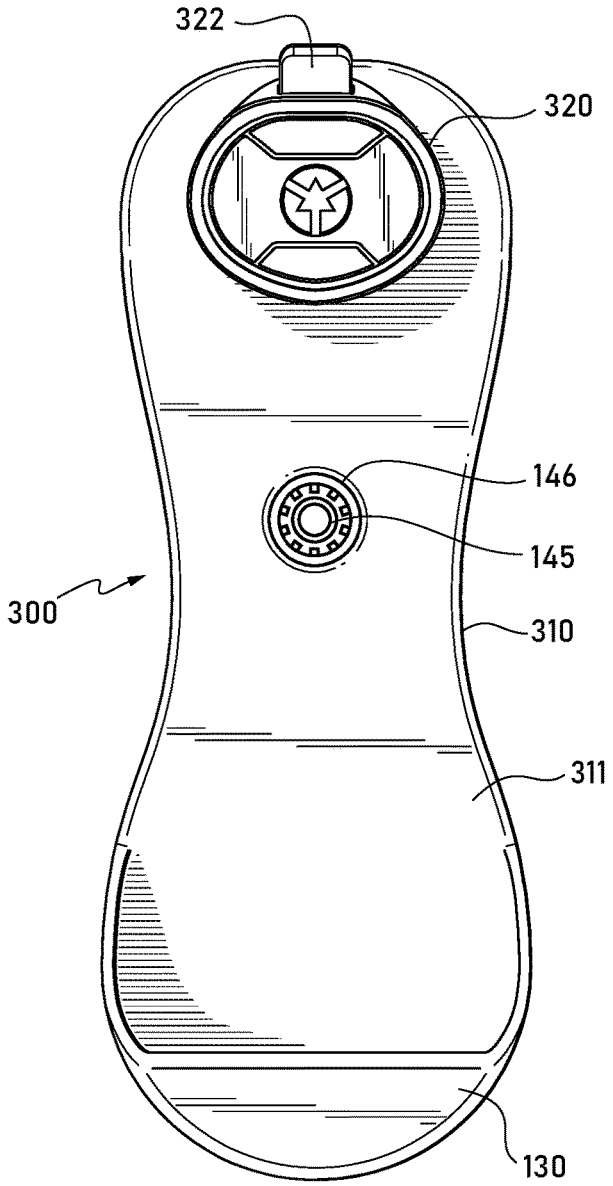
Figure 16B:
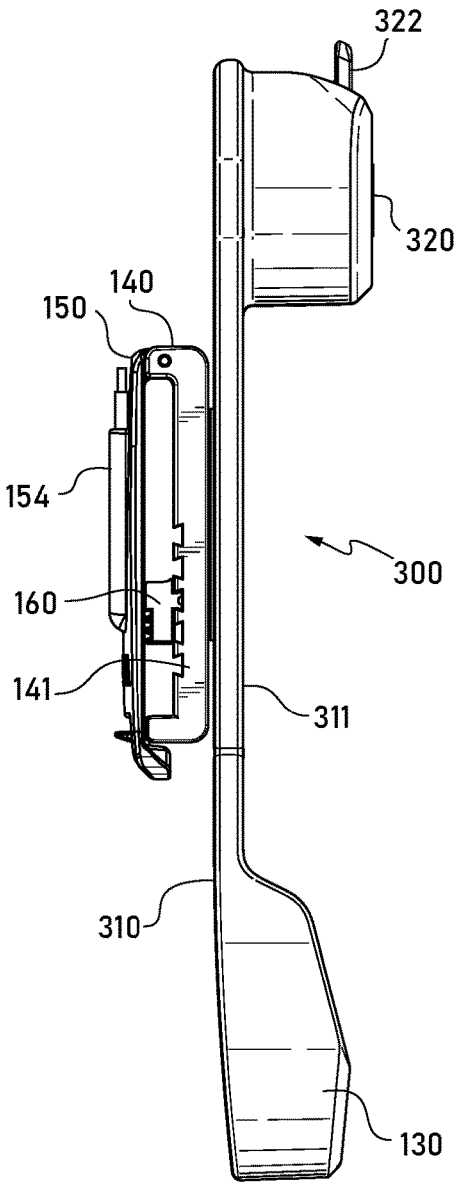
Figure 17:
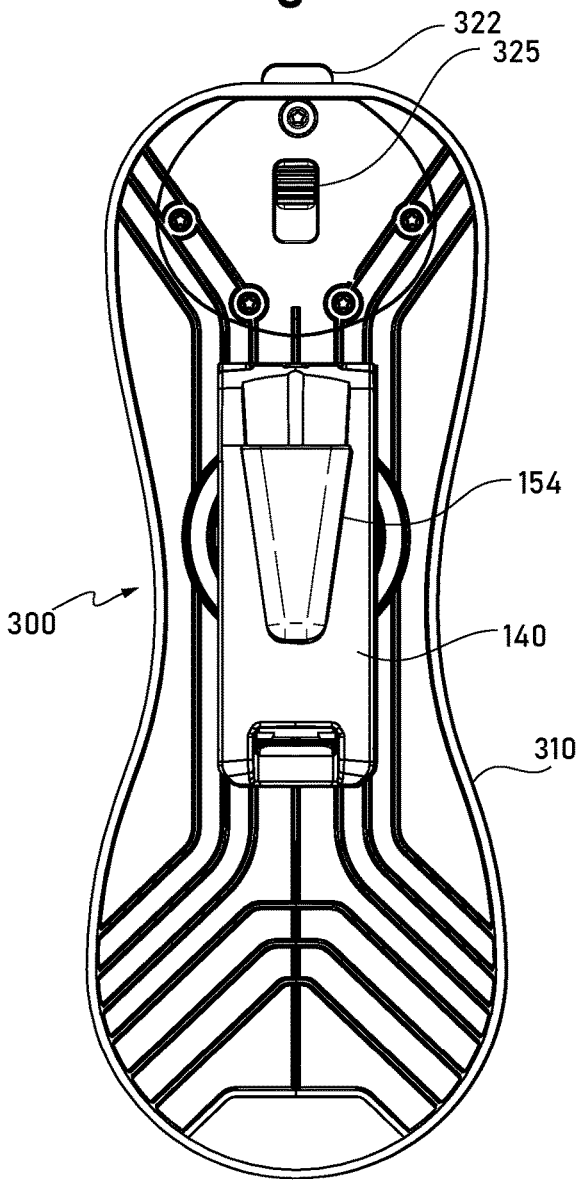
FIG. 17 is a rear view of the embodiment of FIG. 15B.
Figure 18:
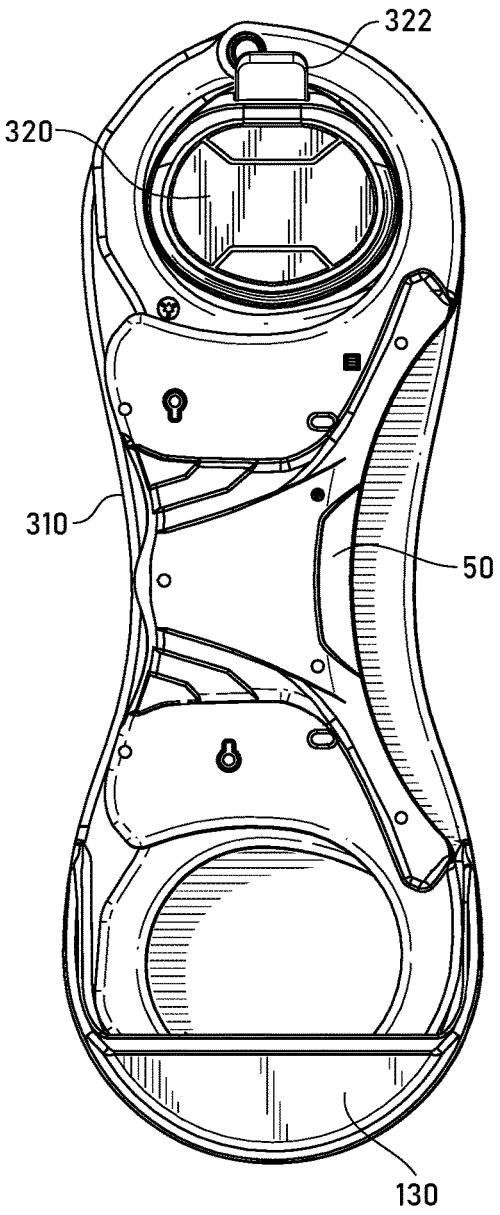
FIG. 18 is a perspective view of the embodiment of FIG. 15B, with a pair of rigid handcuffs received in the case.

FIGS. 15A and 15B, 16A and 16B, and 17 illustrate front, side and rear views, respectively, of another embodiment of a carrying case 300 for carrying a pair of rigid handcuffs 50. FIGS. 15A and 16A show retaining mechanism 322 in a retracted position, and FIGS. 15B and 16B show retaining mechanism 322 in an extended position. FIG. 18 illustrates the carrying case 300 of FIG. 15B with a pair of rigid handcuffs 50 received in the case 300. The case 300 comprises a rigid frame 310. A front side of the frame 310 is structured and dimensioned to receive each one of the two handcuffs of the rigid pair of handcuffs 50 at respective ends of the case 300, and has a substantially planar surface 311 between the two ends.

The protrusion 320 is structured and dimensioned to be surrounded by one of the two handcuffs, and comprises the retaining mechanism 322 and a lock switch 325. The lock switch 325 controls whether the retaining mechanism 322 is in the extended position impeding removal of the pair of rigid handcuffs 50 from the case 300 (as seen in FIGS. 15B, 16B, 17 and 18), or whether the retaining mechanism 322 is in the retracted position not impeding removal of the pair of rigid handcuffs 50 from the case 300 (as seen in FIGS. 15A and 16A). The retaining mechanism 322 is in the extended position when the lock switch 325 is in a locked position, and is in the retracted position when the lock switch 325 is in an unlocked position.

Figure 19:
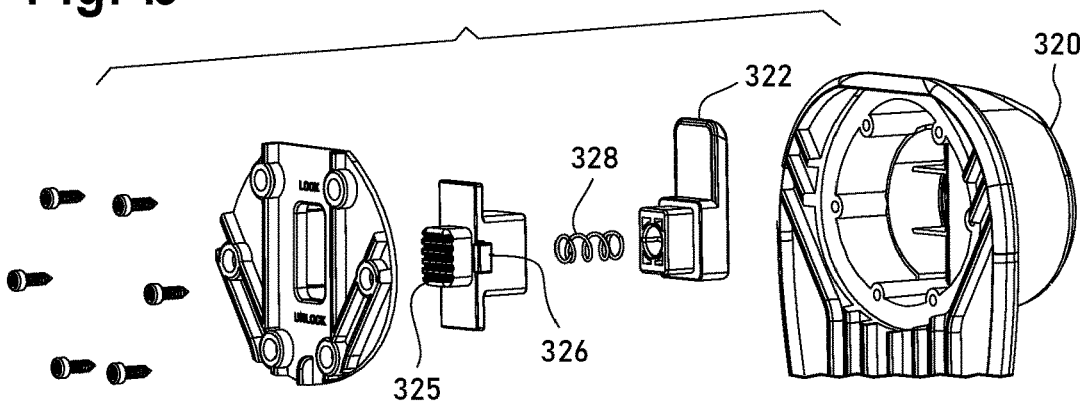
FIG. 19 is an exploded view of the lock switch and retaining mechanism, showing how they engage with the rear side of the frame of the embodiment of FIGS. 15A and 15B.
Figure 20:
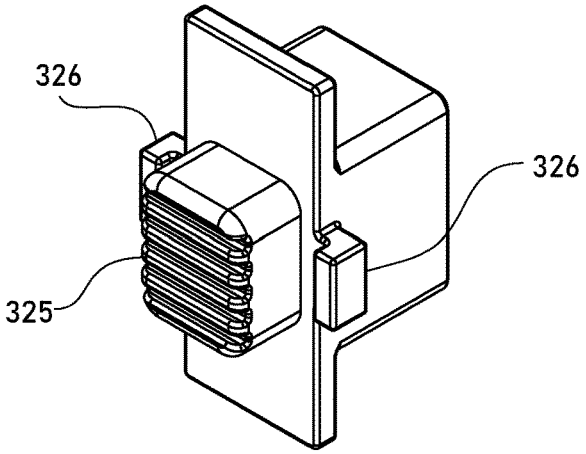
FIG. 20 is a detail view of the lock switch of the embodiment of the FIGS. 15A and 15B.
Figure 21:
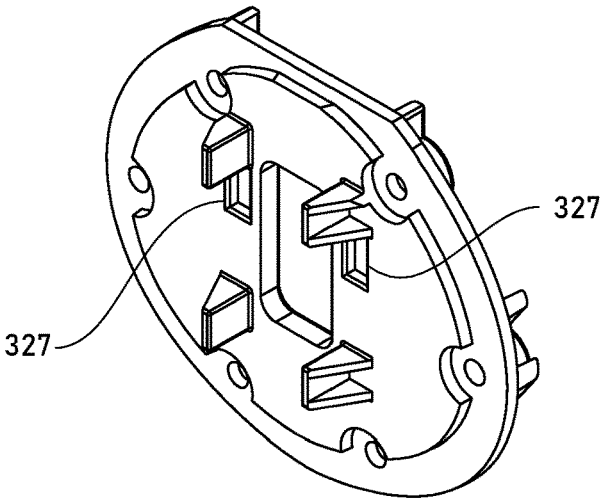
FIG. 21 is a detail view of the inside of the rear surface of the frame that engages with the lock switch of the embodiment of FIGS. 15A and 15B.

As illustrated in FIG. 18, the lock switch 325 is accessible on the rear side of frame 310. FIG. 19 is an exploded view depicting details showing an example of operation of the lock switch 325 and the retaining mechanism 322. FIG. 20 shows details of the lock switch 325, and FIG. 21 shows details of the inside of the rear surface of frame 310 where it engages with the lock switch 325. Projections 326 on opposite sides of the lock switch 325 keep the lock switch 325 depressed when in the unlocked position, and allow the lock switch 325 to slide up to a locked position in a single sliding movement, moving the retaining mechanism 322 to its extended position. However, when the lock switch 325 is in the locked position, spring 328 is biased to push the lock switch 325 out so that the projections 326 engage recessions 327 on the inside of the rear surface of the frame 310, and block the lock switch 325 from moving down to the unlocked position. Only after depressing the lock switch 325 against the force of spring 328 can the lock switch 325 be slid down to the unlocked position, moving the retaining mechanism 322 to its retracted position.

It will be understood that the disclosed carrying case for rigid handcuffs can be modified without departing from the teachings of the invention. Accordingly, the scope of the invention is only to be limited as necessitated by the accompanying claims.

What is claimed is:

1. A case for carrying a pair of rigid handcuffs, the rigid pair of handcuffs comprising two handcuffs and a middle section rigidly joining the two handcuffs so that the two handcuffs are not movable relative to each other, the case comprising:

a rigid frame having opposing first and second ends;

the first end being structured and dimensioned to receive a first one of the two handcuffs;

the second end being structured and dimensioned to receive a second one of the two handcuffs; and the second end comprising a retaining mechanism that impedes removal of the pair of rigid handcuffs from the case unless the retaining mechanism is released.

2. The case of claim 1, the frame having opposite first and second sides, the first side being substantially planar between the first and second ends.

3. The case of claim 1, the first end comprising an arc-shaped pocket for receiving the first handcuff, the pocket being structured and dimensioned to block removal of the first handcuff from the pocket except in a direction substantially towards the second end.

4. The case of claim 3, the first end further comprising a cushion in the pocket.

5. The case of claim 1, the first end comprising a protrusion for receiving the first handcuff, the protrusion being structured and dimensioned to be surrounded by the first handcuff and to block removal of the first handcuff from around the protrusion when the retaining mechanism impedes removal of the second handcuff from the second end.

6. The case of claim 1, the second end comprising a protrusion for receiving the second handcuff, the protrusion being structured and dimensioned to be surrounded by the second handcuff.

7. The case of claim 6, the protrusion being substantially oval-shaped.

8. The case of claim 1, the retaining mechanism being flexible and being biased towards a retaining position in which the retaining mechanism impedes the removal of the pair of rigid handcuffs from the case, and being adapted to be flexed to a releasing position in which the removal of the pair of rigid handcuffs from the case is not prevented by the retaining mechanism.

9. The case of claim 8, the second end comprising a protrusion for receiving the second handcuff, the protrusion being structured and dimensioned to be surrounded by the second handcuff; and the retaining mechanism being shaped to facilitate flexing of the retaining mechanism from the retaining position to allow receipt of the second handcuff in the second end when the second handcuff is pushed over the protrusion, and to impede removal of the second handcuff from around the protrusion when the retaining mechanism is in the retaining position.

10. The case of claim 1, further comprising a releasing mechanism that, when the releasing mechanism is activated, moves the retaining mechanism to a releasing position to allow the removal of the pair of rigid handcuffs from the case.

11. The case of claim 10, further comprising a lock switch that prevents activation of the releasing mechanism when the lock switch is in a locked position.

12. The case of claim 11, wherein the retaining mechanism is adapted to be flexed from a retaining position, in which the retaining mechanism impedes the removal of the pair of rigid handcuffs from the case, to allow receipt of the second handcuff in the second end even when the lock switch is in the locked position.

13. The case of claim 11, the frame having opposite first and second sides, the first side being adapted for receiving the rigid pair of handcuffs; and the lock switch being located on the second side.

14. The case of claim 1, the frame having opposite first and second sides, the first side being adapted for receiving the rigid pair of handcuffs; and the case further comprising a clip, the clip being joined to the second side of the frame.

15. The case of claim 14, the case further comprising a pivoting joint that rotatably joins the clip to the frame.

16. The case of claim 15, the pivoting joint allowing rotation of the frame relative to the clip only through a predetermined arc.

17. The case of claim 15, the pivoting joint comprising projections and slots that facilitate retention of the frame at any one of a plurality of predetermined orientations with respect to the clip.

18. The case of claim 14, the clip comprising an adjustable spacer to accommodate attachment of the clip to a plurality of different size items.

19. The case of claim 14, the clip comprising a key pocket that is structured and dimensioned to receive a key for the rigid pair of handcuffs.

20. The case of claim 1 further comprising a lock switch that controls whether the retaining mechanism is in an extended position impeding removal of the pair of rigid handcuffs from the case, or whether the retaining mechanism is in a retracted position not impeding the removal of the pair of rigid handcuffs from the case.

21. The case of claim 20, wherein the retaining mechanism is in the extended position when the lock switch is in a locked position;

the retaining mechanism is in the retracted position when the lock switch is in an unlocked position;

the lock switch can be moved from the unlocked position to the locked position in a single sliding movement; and the lock switch can be slidingly moved from the locked position to the unlocked position only after the lock switch is depressed.

* * * * *